United States Patent [19]

Ryan et al.

[11] Patent Number: 5,044,629

[45] Date of Patent: Sep. 3, 1991

[54] WHEELCHAIR ACCESSIBLE WEIGHT TRAINING APPARATUS

[76] Inventors: Stephen Ryan, 3135 Cambourne, Crescent, Mississauga, Ontario, Canada, L5N 5E8; Stephen Naumann, 5937 Bathurst Street, No. 4, Willowdale, Ontario, Canada, M2R 1Y8

[21] Appl. No.: 334,662

[22] Filed: Apr. 6, 1989

[51] Int. Cl.[5] ..... A63B 21/06

[52] U.S. Cl. ..... 272/118; 272/116

[58] Field of Search ..... 272/117, 118, 134, 93, 272/116, 123, DIG. 4, 130, 62

[56] References Cited

U.S. PATENT DOCUMENTS

| | | | |
|---|---|---|---|
| 3,524,644 | 8/1970 | Kane | 272/134 |
| 4,153,244 | 5/1979 | Tauber, Jr. | 272/123 X |
| 4,591,147 | 5/1986 | Smith et al. | 272/69 |
| 4,591,149 | 5/1986 | Godfrey | 272/118 |
| 4,747,595 | 5/1988 | Mabry et al. | 272/118 |
| 4,776,587 | 10/1988 | Carlson et al. | 272/134 |
| 4,784,384 | 11/1988 | Deola | 272/134 X |
| 4,795,149 | 1/1989 | Pearson | 272/134 X |
| 4,836,535 | 6/1989 | Pearson | 272/118 |

*Primary Examiner*—Richard J. Apley
*Assistant Examiner*—H. N. Flaxman
*Attorney, Agent, or Firm*—Caesar, Rivise, Bernstein, Cohen & Pokotilow, Ltd.

[57] ABSTRACT

An exercise equipment for use by people in wheelchairs has a stationary frame within which a user can readily located their wheelchair, including attachment structure for securing the lower body of the user to the chair. A guide frame pivotally secured to the stationary frame is readily adjustable in its angle of inclination, which angle defines the plane of displacement in which weight-lifting exercise is performed by the user. A load bar is secured to the guide frame, for displacement therealong by the user, in carrying out their selected exercise. The load bar is connected by its ends in load transfer relation with two sets of selectively adjustable weights. Use of a load bar in sliding relation with a guide frame diminishes the risk of loss of control of the weights. The equipment may be readily used and adjusted in relation to the angle of lift and the required weight load, by a majority of users, despite significant incapacitation.

11 Claims, 6 Drawing Sheets

WHEELCHAIR ACCESSIBLE WEIGHT TRAINING APPARATUS

FIELD OF THE INVENTION

This invention is directed to exercise equipment and in particular to exercise equipment for use by individuals while occupying a wheelchair.

BACKGROUND OF THE INVENTION

The achievement and maintenance of bodily health in the case of people who are confined to wheelchairs is greatly facilitated by suitable exercise within the capability of the individual, while such athletic achievement by these individuals is an important factor in the maintenance of morale and in enhanced public perception of the handicapped.

Certain prior arrangements of exercise apparatus for wheelchair users can be seen in U.S. Pat. Nos. 4,153,244 May 1979 Tauber; 4,402,502 September 1983 Peters; and 4,747,595 May 1988 Mabry et al.

However, the appartuses of these earlier patents do not achieve the range of movement and facility of use achieved by the present invention.

Thus, in the case of Tauber a weight lifting apparatus has a frame which surrounds the wheelchair of the user, thus generally requiring third party assistance in reassembling one side of the surrounding frame, to contain the chair of the user. The arrangement provides a vertical guide frame with slider dumbbells for a vertical press, and hand held stirups for pulling exercises, and is somewhat limited in its range of use.

Peters provides a modified form of exercycle, intended to provide pedalling type exercises for both arms and legs, with motor assistance where required. No wheelchair restraint is provided, and the apparatus appears directed for use primarily by persons suffering from a tendency to muscle spasms.

The Mabry et al. device provides a frame to receive a wheelchair and occupant in secure relation, having a series of adjustable weights, displaceable by tension cables. These cables include one pair "for connection with a curl bar or other exercise implement", which is not illustrated. No provision appears to be made to tether such a curl bar or other exercise implement, or provide any form of restraint or protective safety device for the user, while the presence of a curl bar severely limits the extent of use of the apparatus.

SUMMARY OF THE INVENTION

The present invention provides a free standing equipment configured to allow a user to enter therein while seated in a wheelchair, and to remain thus seated while exercising against a force bar selectively loaded with weights. The weights are conveniently located adjacent to the sides of the user, to facilitate ready selection, generally by the user, of the load to be applied to the force bar. An adjustable guide frame pivotally attached to the stationary frame of the equipment has a wide range of angular settings, the selected angle of which defines the plane of displacement of the force bar, as determined by the user.

Securement of the force bar ends in sliding relation with the guide frame provides restraint of the force bar, limiting it to parallel displacement in the plane of the frame.

A pair of linear gas spring compensators offset the self weight of the guide frame, and facilitate making adjustment to the inclination of the guide frame. The compensators are provided with readily actuated release levers, to facilitate their utilization from the confines of a wheelchair, and to enable ready adjustment of the guide frame angle by a user having limited gripping strength.

Cable and pulley arrangements interconnect the force bar to the selected weights, to preclude the likelihood of injury to the user in the event that control over the force bar is inadvertently lost.

Resilient bumper stops are provided to absorb impact forces that may occur upon uncontrolled release of the force bar.

While the preferred embodiment is arranged having the force bar loaded in a retractive sense, such that the user thrusts outwardly to displace the thrust bar along its guide frame, it is contemplated that by the addition of a further pair of guide pulleys the thrust bar may be used in a pulling sense.

A weight selector mechanism incorporates a selector spigot having an enlarged head portion, to facilitate use thereof by individuals having impaired grasping capabilities.

Thus there is provided an exercise apparatus having a force bar for displacement by a user;

adjustable weight means to provide a predetermined load;

guide means to restrain the force bar for displacement in a predetermined orientation and direction;

resilient restraint means for securing the guide means in a predetermined angular orientation, and force transfer means connecting the weights to the force bar to provide dead weight loading thereagainst in a predetermined direction.

BRIEF DESCRIPTION OF THE DRAWINGS

Certain embodiments of the present invention are described for purposes of illustration, without limitation of the invention thereto, reference being made to the accompanying drawings, wherein.

DETAILED DESCRIPTION OF THE INVENTION

Figure 1:
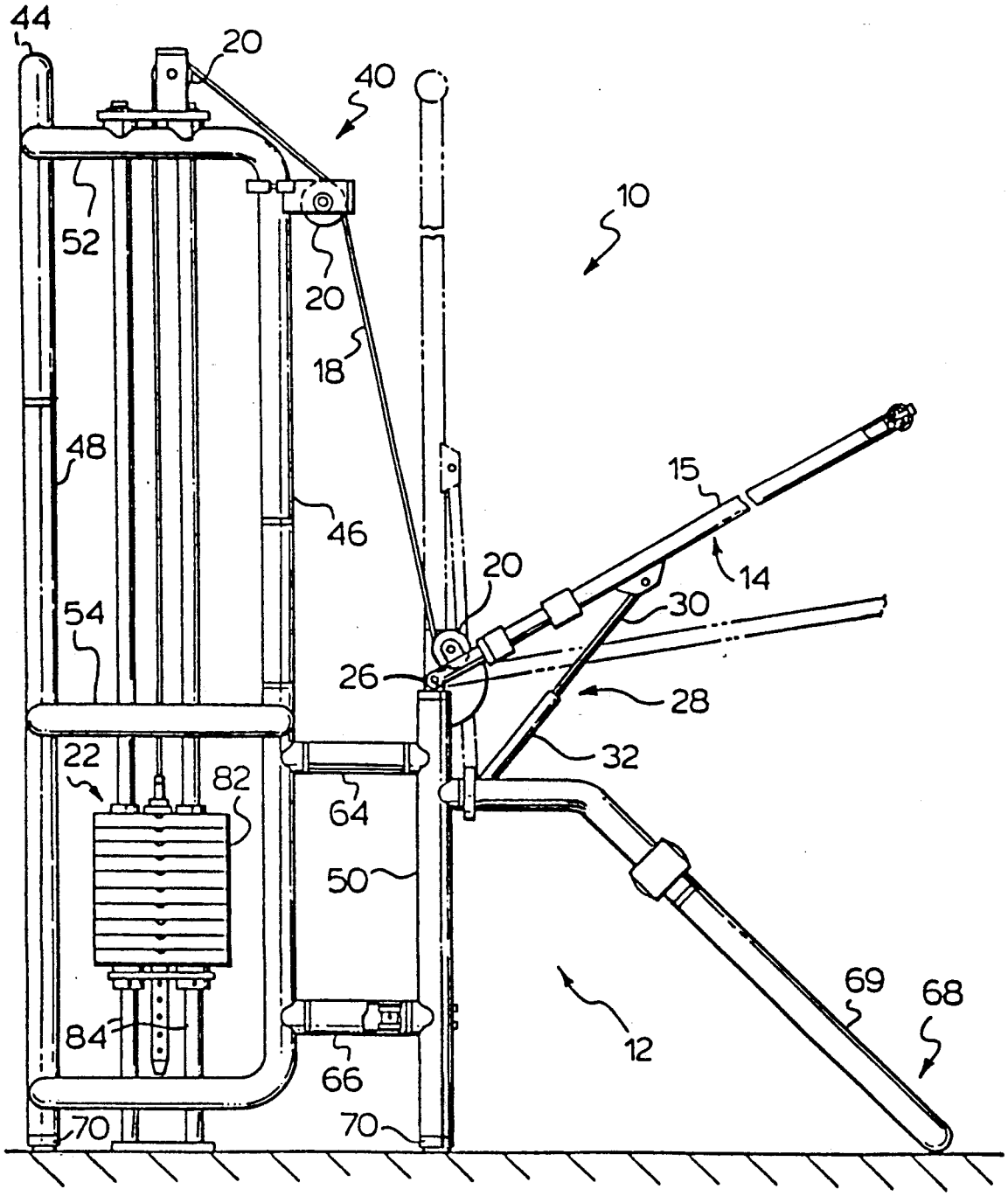
FIG. 1 is a side elevational view of an apparatus in accordance with the invention.
Figure 2:
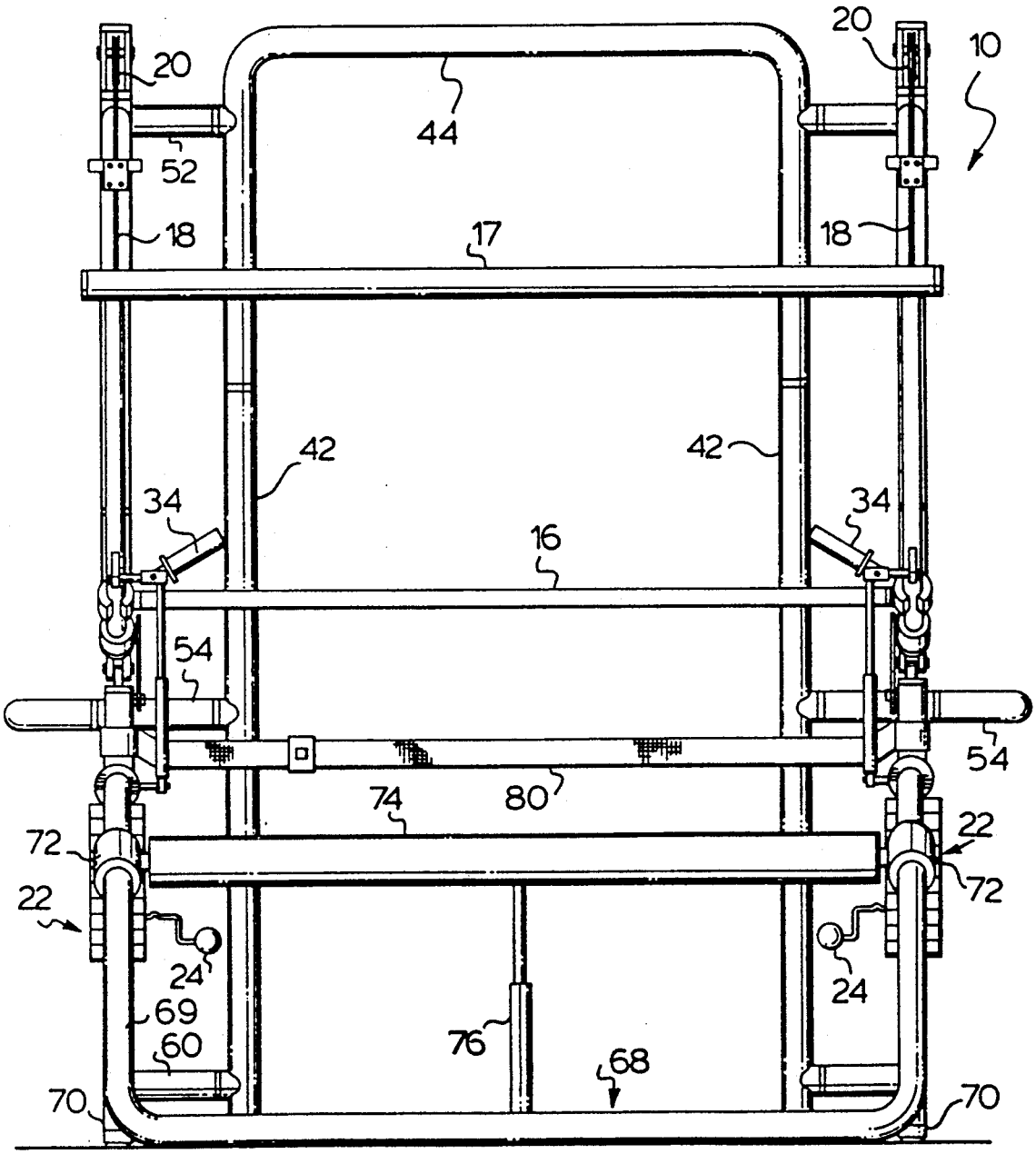
FIG. 2 is a front elevational view of the apparatus.
Figure 3:
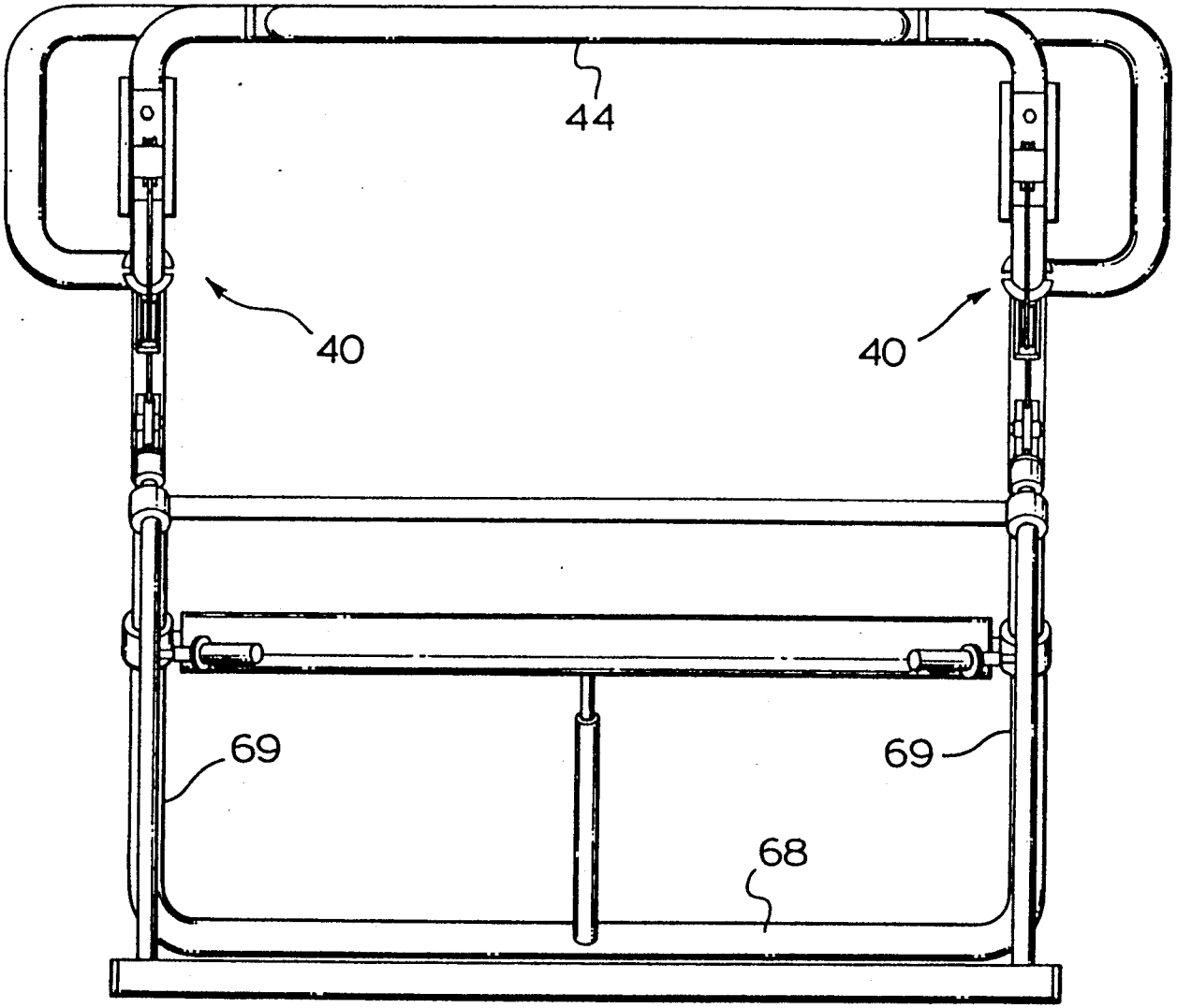
FIG. 3 is a plan view of the apparatus.
Figure 4:
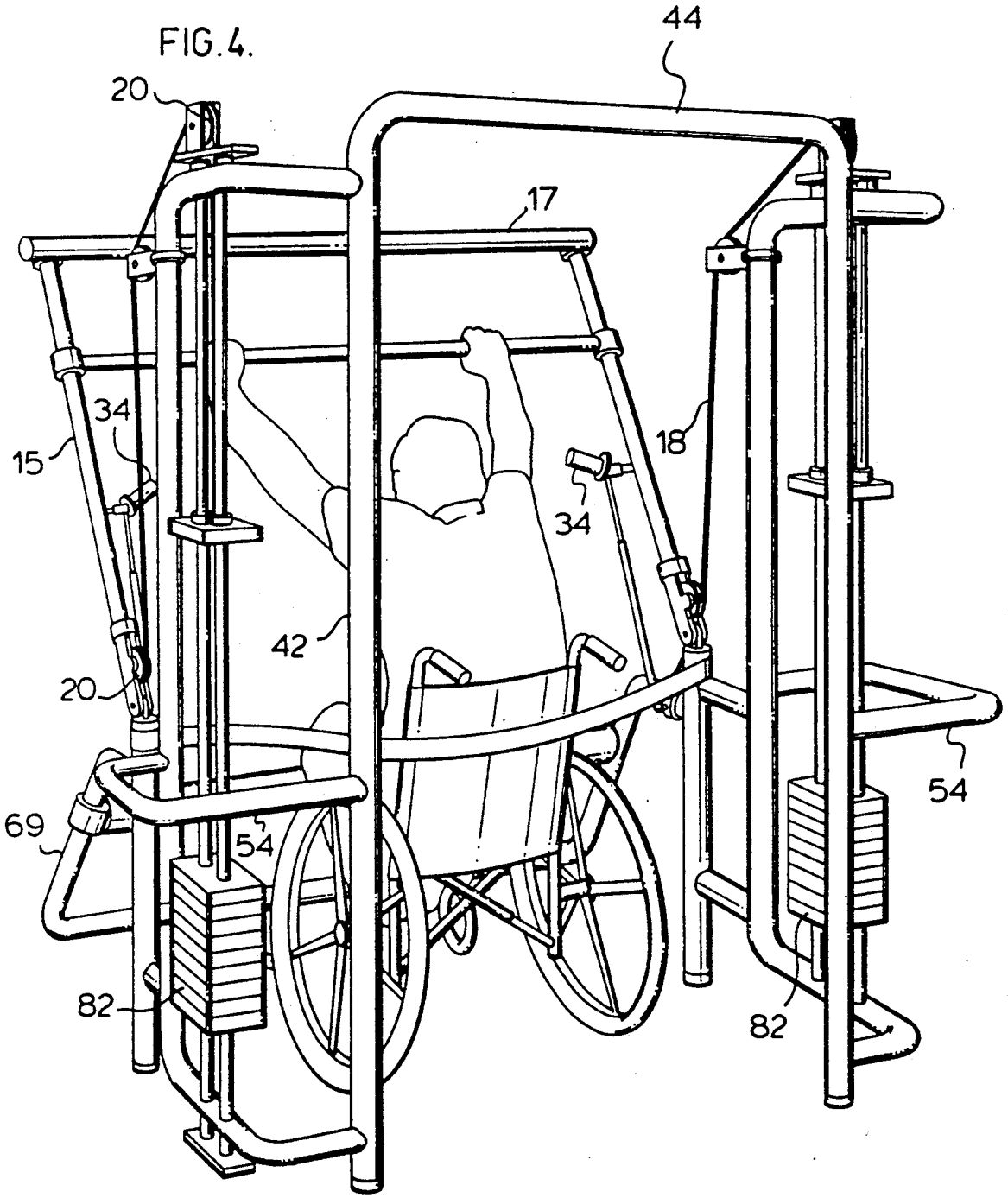
FIG. 4 is a perspective view of a user working the apparatus.
Figure 5:
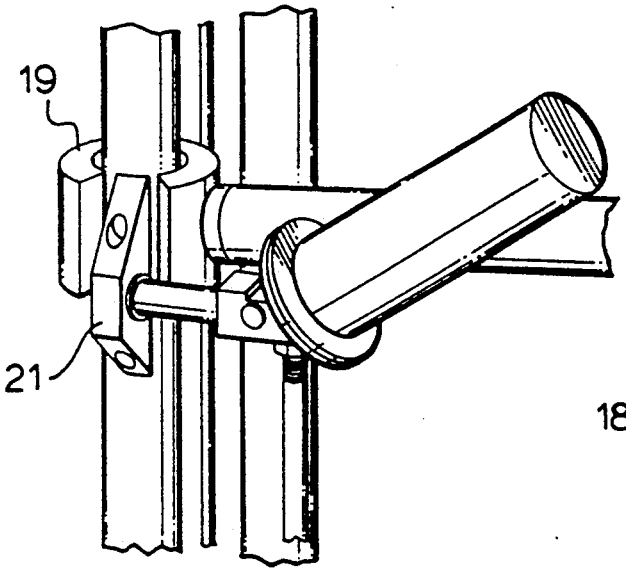
FIG. 5 is an enlarged view of a thrust bar angle adjustment lever.

Referring to FIGS. 1, 2 and 3, the apparatus 10 comprises a complex stationary support frame 12, having a plurality of tubular members, described in detail below, an angularly adjustable guide frame 14 and a displaceable force bar 16.

At each side of the guide frame 14 force transfer means comprising cables 18 and pulleys 20 connect with selectively adjustable weight means 22, having a weight stack selector key 24, with enlarged head portion 25.

The guide frame 14 is pivotally attached at 26 to the support frame 12 and has side members 15 and a cross member 17. A pair of commercial locking gas spring assemblies 28 comprising a piston rod 30 and cylinder 32 are pivotally attached at their respective ends to guide frame 14 and the support frame 12. Spring loaded control handles 34 provide release of the spring assemblies 28 by downward pivotal displacement of handles 34, to open an interior flow valve, for angular repositioning of guide frame 14.

Figure 6:
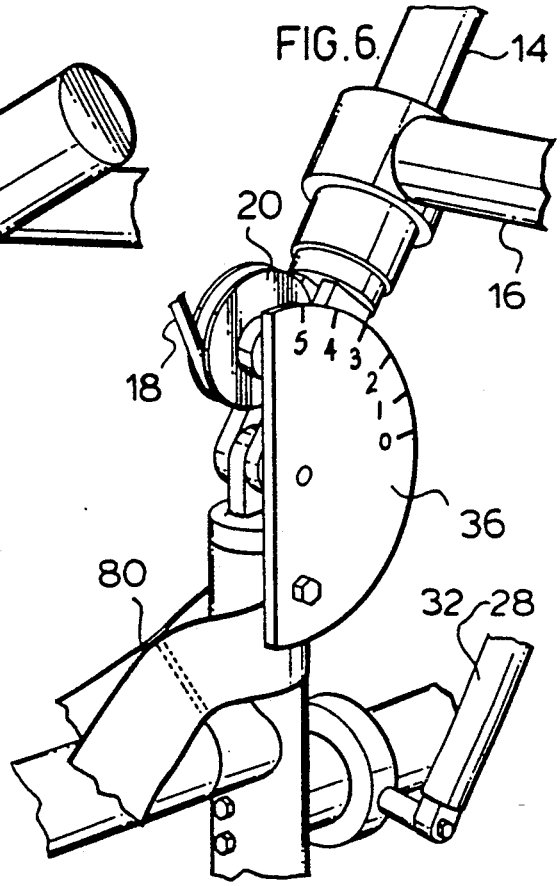
FIG. 6 is a perspective view of a detail of a guide frame pivot and a force transfer cable pulley.
Figure 7:
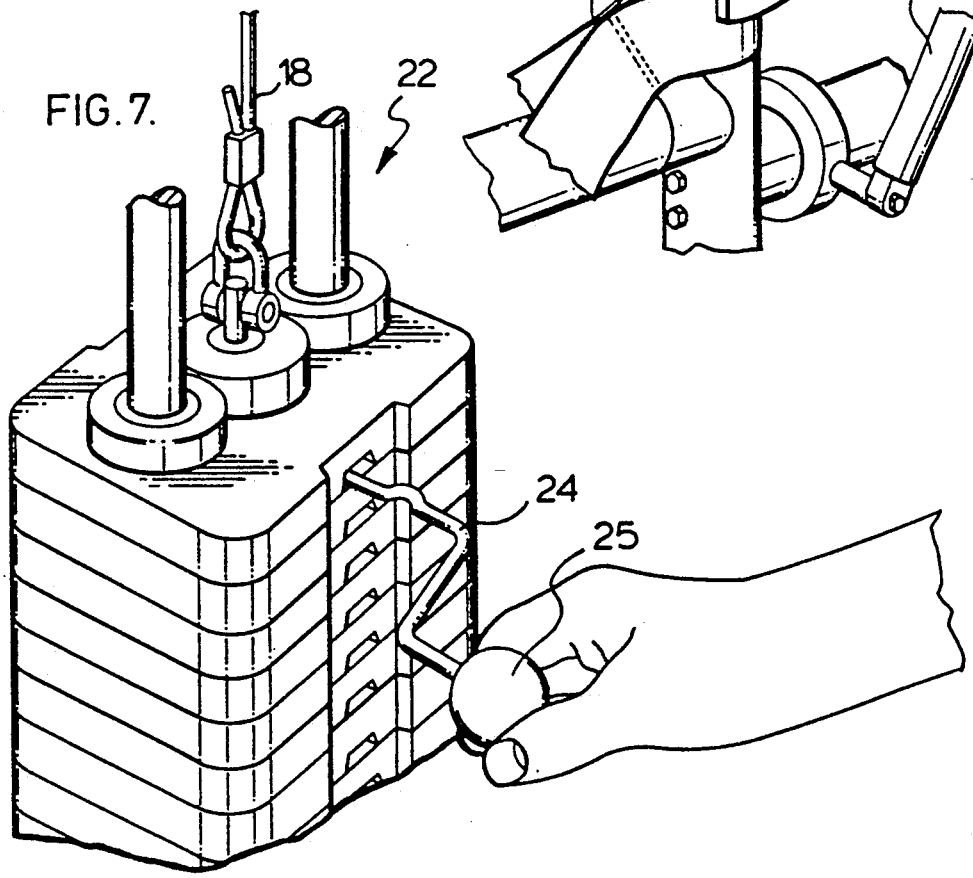
FIG. 7 is a perspective view of a user inserting a weight selection key into a weight stack.
Figure 8:
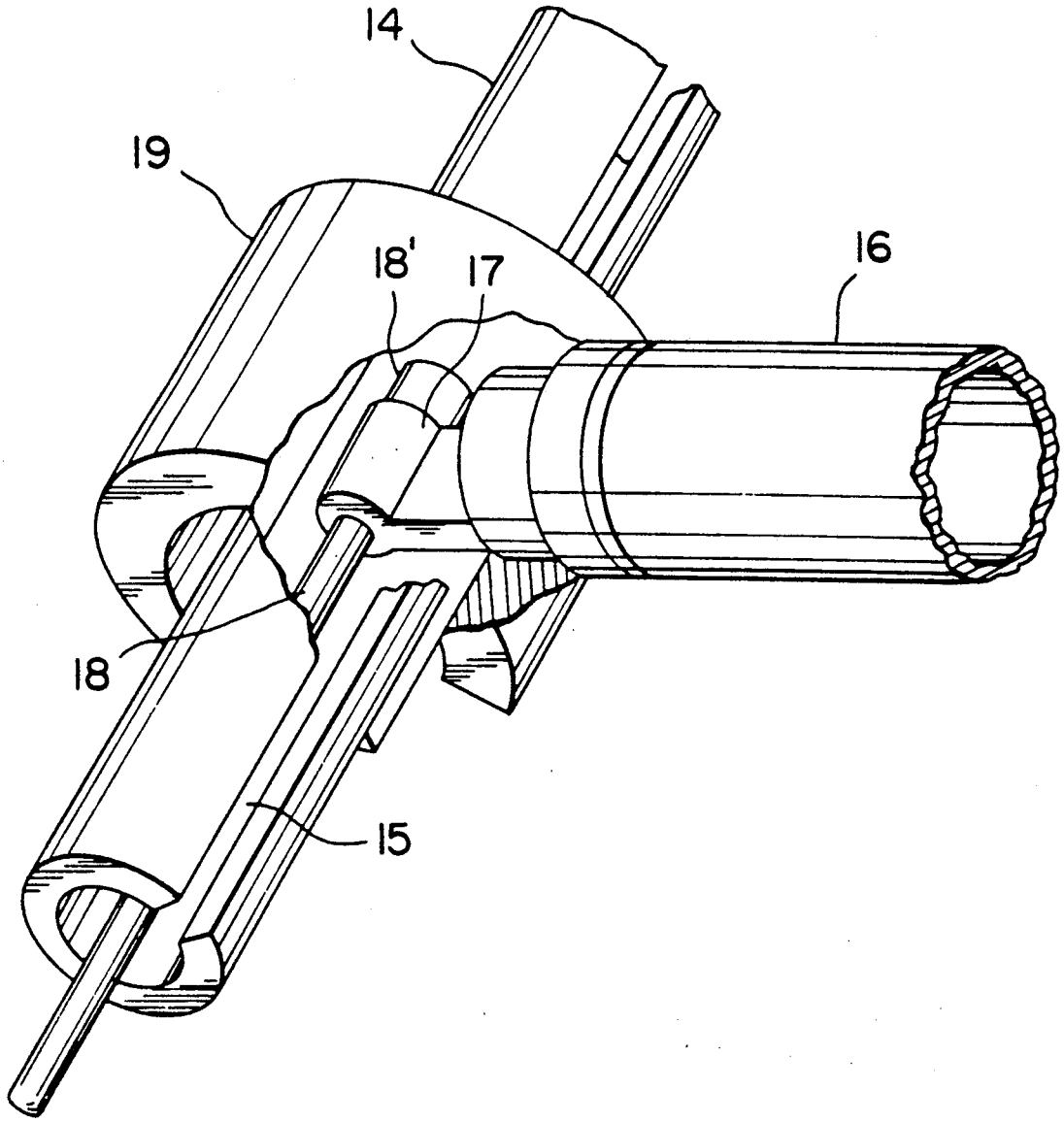
FIG. 8 is an enlargement, in partial section, of a portion of FIG. 6.

Referring to FIG. 6, there is illustrated an index quadrant 36 graduated from zero to five, having guide frame 14 set at an intermediate indexed position, inclined upwardly at about 60° from the horizontal.

Referring in FIGS. 1, 2 and 3, to the support frame 12, constructed of disassembleable tubular steel segments in the preferred embodiment, there is provided on each side thereof an upstanding tower portion 40, each having an upright member 42 connecting with a U-shaped member 44 securing as a transverse bridge uniting the two tower portions 40.

Parallel upright tower members 46, 48, and pedestal portion 50 constitute corner members of each tower, being interconnected by curved transverse portions 52, 54 and links 64, 66. The offset, forwardly located pedestal portions 50, secured to the respective tower members 46 by way of links 64, 66 are interconnected by a forwardly extending, downwardly cranked U-shaped floor contact member 68.

Pedestal portions 50 are surmounted by pivotal mounts 26 of the guide frame 14.

Levelling foot portions 70 permit levelling adjustment of the apparatus 10.

Attachment sleeves 72 slidably secured to the side arms 69 of member 68 carry a padded knee bar 74 in horizontally extending adjustably attached relation therebetween. A locking extensible central brace 76 interconnects knee bar 74 with member 68.

An adjustable restraint strap 80 secured to upper end portions of pedestal portions 50 extends across the apparatus, in use to secure a user with their knees in pressing relation against knee bar 74, the strap 80 generally being located behind the back of the user.

Alternatively, the strap 80 may be passed behind the back of the user's wheelchair.

The weight stacks 22 each have a selector key 24, having an enlarged, readily grippable handle 25. This is particularly important in the case of users lacking fine motor control, as it facilitates their use of the weight selector device by which the user can select the dead load applied on the respective cables 18. The weights 82 slide vertically along guide bars 84.

The force bar 16 is slidably mounted upon frame 14 side members by way of DELRIN (TM) low friction bearings. The bearings, in the form of a slotted sleeve 19, slide on the outer surface of frame 14, the slots affording clearance from brackets 21 by which gas spring assemblies 28 are attached to frame 14. Rubber bumper stops, not shown, are located within the sleeves 19. The bearings 19 maintain the bar 16 in constrained, parallel relation, to optimize safety in case of loss of control when in use.

The side members of frame 14 are of heavy wall tube, each having a slot 15 extending axially along its length, through which slots connecting arms 17 extend, connecting the ends of force bar 16 with the respective cables 18 of the weight system; by way of end fittings 18' crimped to the respective cable 18.

In the illustrated embodiment the angle of frame 14 may be readily adjusted by most wheelchair users to a preferred angle varying from substantially horizontal to substantially vertical. Depression of handles 34 serves to release the spring assemblies 28, for subsequent resetting of guide frame 14 by the user to a preferred press angle, in a ninety degree range. Once reset, by release of handles 34, the gas spring assemblies 28 maintain the frame 14 in firmly secured relation at the selected angle. The gas spring assemblies 28 are pressure-biased upwardly. With handles 32 depressed, even by the wrists of the user, the frame 14 may be pivoted upwardly, under the influence of the gas springs 28, or pivoted readily downwardly, against the moderate out-of-balance gas force, to a more horizontal position. The force requirement is minimal, to enable adjustment using only the wrists.

Attachment and adjustment of the restraint strap 80 by the user secures the user in a desired position, having their knees in bracing relation against knee bar 74. The height of bar 74, which is padded, may be readily adjusted by the user.

Selection of the desired weight load by way of stack selector key 24 is readily effected by most users, the stack selector key 24 having an enlarged head portion 25 to facilitate use thereof.

The subject apparatus is secured at the respective joints by commercial tube connectors, making for rapid dissassembly and reassembly of the apparatus 10, for transportation to and within a users house.

The presently disclosed apparatus has been used for extended periods by many wheelchair users having disabilities such as paraplegia, spina bifida, leg amputation, multiple sclerosis, cerebral palsy, and equilibrium problems.

It has been found that a majority of such users can carry out all the functions necessary to enable them to secure themselves safely within the apparatus; adjust the guide frame 14; select the desired weights, and safely operate the apparatus in carrying out press exercises.

The gas spring assemblies 28 are based upon commercial units similar to those used in automobile rear gate lift assemblies, but having a valve actuated by handles 34 for free repositioning.

As previously mentioned, use of another embodiment having a pair of additional pulleys, for use of the force bar in a pulling sense also in contemplated.

What is claimed:

1. An apparatus for use by occupants of wheelchairs, to enable selective exercising of the upper body of the user, comprising stationary frame means for securement of a wheelchair seated user at an exercise location within said frame;

an angularly adjustable guide means pivotally secured substantially at mid-body level to said stationary frame means for relative outward adjustment by said seated user, in secured angularly inclined relation from said frame means;

a laterally extending, substantially horizontal force bar slidably supported by said guide means and movable along the guide means;

selectively adjustable load means located adjacent said exercise location and accessible, in use by said user when seated in said wheelchair in said exercise location; and force transfer means interconnecting the load means and the force bar in load transfer relation therebetween in use to permit upper body exercising by said user in displacing a load selectable by the user, at a selected angle of load displacement along said guide means.

2. The apparatus as set forth in claim 1, having adjustable load transfer means interconnected between said adjustable guide means and said stationary frame means, to facilitate adjustment of said guide means relative to said frame means.

3. The apparatus as set forth in claim 2, said adjustable load transfer means comprising gas spring means secured to said adjustable guide means and said stationary frame means.

4. The apparatus as set forth in claim 1 including user restraint means secured to said frame means, in use to permit a user in a wheelchair to secure themselves in substantially immobilized relation to the apparatus.

5. The apparatus as set forth in claim 4, said user restraint means being adjustable by said user when seated in said exercise position, and including a padded front bar adjustably locatable at knee height, and an adjustable safety strap to secure the user in secured relation relative thereto.

6. The apparatus as set forth in claim 1, said selectively adjustable load means comprising a selectively variable load stack located one on each side of the apparatus, having load selector means enabling ready selection of said load; said load selector means being readily accessible by said user when seated in said exercise location.

7. The apparatus as set forth in claim 1, said force transfer means comprising guide pulleys having cables guided thereover in connecting relation between said force bar and said load means, portions of the cables adjacent said user being contained within said guide means, to avoid hindrance to said user.

8. The apparatus as set forth in claim 1, said stationary frame means comprising a plurality of tubular frame members removably secured in mutually assembled relation.

9. The apparatus as set forth in claim 8, said frame means including adjustable foot portions for levelling the frame means.

10. The apparatus as set forth in claim 1, said adjustable guide means comprising a U-shaped frame with a pair of parallel leg portions and an intermediate connection portion, pivotally mounted at the ends of said leg portions from said stationary frame means; said force bar being positioned substantially parallel with said intermediate connecting portion, for sliding displacement along said leg portions.

11. The apparatus as set forth in claim 3, said gas spring means providing sole positioning support of said guide means, and having an inner end thereof connected in pivotal relation with said stationary frame means, and an outer end thereof connected with said guide means; gas spring control means having a projecting handle engageable, in use by the wrist of said user, when seated, to release said gas spring and to selectively reposition said guide means to said selected angle of load displacement.

* * * * *